US011874098B2

(12) United States Patent
Muller et al.

(10) Patent No.: US 11,874,098 B2
(45) Date of Patent: Jan. 16, 2024

(54) WIRELESS DETONATOR ASSEMBLY

(71) Applicant: DETNET SOUTH AFRICA (PTY) LTD, Johannesburg (ZA)

(72) Inventors: Elmar Lennox Muller, Johannesburg (ZA); Christiaan Tielman Meyer, Johannesburg (ZA); Abraham Johannes Liebenberg, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 238 days.

(21) Appl. No.: 17/620,506

(22) PCT Filed: Feb. 2, 2021

(86) PCT No.: PCT/ZA2021/050006
§ 371 (c)(1),
(2) Date: Dec. 17, 2021

(87) PCT Pub. No.: WO2021/222947
PCT Pub. Date: Nov. 4, 2021

(65) Prior Publication Data

US 2022/0357141 A1 Nov. 10, 2022

(30) Foreign Application Priority Data

Apr. 29, 2020 (NA) ..... NA/P/2020/0010

(51) Int. Cl.
*F42C 15/42* (2006.01)
*F42D 1/05* (2006.01)

(52) U.S. Cl.
CPC ..... *F42C 15/42* (2013.01); *F42D 1/05* (2013.01)

(58) Field of Classification Search
CPC ..... F42C 15/42; F42D 1/05
(Continued)

(56) References Cited

U.S. PATENT DOCUMENTS 4,724,766 A * 2/1988 LaBudde ..... F42B 12/58 102/393
5,284,094 A * 2/1994 La Mura ..... F41A 33/04 102/215

(Continued)

FOREIGN PATENT DOCUMENTS

CN 106643350 A 5/2017
WO 2012061850 A1 5/2012

(Continued)

OTHER PUBLICATIONS

International Preliminary Report on Patentability for PCT/ZA2021/050006, international filing date of Feb. 2, 2021, date of completion Oct. 4, 2021, 10 pages.

(Continued)

*Primary Examiner* — Samir Abdosh
(74) *Attorney, Agent, or Firm* — CANTOR COLBURN LLP

(57) ABSTRACT

A wireless detonator assembly which includes a detonator, a receiver, a printed circuit board with a stored key which is hardwired onto the board during manufacture of the detonator assembly and control logic which allows the detonator to be fired only if the control logic extracts from a signal, received by the receiver, a reference key which is identical to the stored key.

3 Claims, 2 Drawing Sheets

(58) Field of Classification Search
USPC ..... 102/215
See application file for complete search history.

(56) References Cited

U.S. PATENT DOCUMENTS

| | | | | |
|---|---|---|---|---|
| 6,105,688 | A * | 8/2000 | Vaynshteyn | F42D 1/055 175/4.54 |
| 6,860,206 | B1 * | 3/2005 | Rudakevych | F42C 15/42 701/1 |
| 11,733,009 | B2 * | 8/2023 | Wu | F42B 4/00 102/215 |
| 2016/0047635 | A1 * | 2/2016 | Revord | F41H 13/00 89/1.11 |
| 2023/0280141 | A1 * | 9/2023 | Thottethodi | F42D 1/05 102/206 |

FOREIGN PATENT DOCUMENTS

| | | | | |
|---|---|---|---|---|
| WO | 2015039147 | A2 | 3/2015 | |
| WO | WO-2019147294 | A1 * | 8/2019 | E21B 43/1185 |
| WO | WO-2019173601 | A1 * | 9/2019 | F42D 1/05 |
| WO | WO-2021222947 | A1 * | 11/2021 | F42C 15/42 |

OTHER PUBLICATIONS

International Search Report for PCT/ZA2021/050006, international filing date of Feb. 2, 2021, dated May 7, 2021, 4 pages.
Written Opinion for PCT/ZA2021/050006, international filing date of Feb. 2, 2021, dated May 7, 2021, 5 pages.

* cited by examiner

WIRELESS DETONATOR ASSEMBLY

CROSS-REFERENCE TO RELATED APPLICATIONS

This application is a U.S. national stage application of International Application No. PCT/ZA2021/050006 entitled "WIRELESS DETONATOR ASSEMBLY, which has an international filing date of 2 Feb. 2021, and which claims priority to Namibian Patent Application No. NA/P/2020/0010, filed 29 Apr. 2020.

BACKGROUND OF THE INVENTION

This invention relates to a wireless detonator assembly.

A wireless detonator assembly installed in a borehole, once rendered operative by means of an arm command which is sent wirelessly, is initiated upon receipt of a fire command, also sent wirelessly. It is essential, as far as is possible, to eliminate the possibility that initiation can take place inadvertently e.g. due to receipt of a stray signal.

An object of the present invention is to address at least to some extent the aforementioned aspect.

SUMMARY OF THE INVENTION

The invention provides a wireless detonator assembly which includes a receiver, a memory unit, a power source, control logic, a detonator and explosive material which is initiated, after receipt of an arm command, upon receipt by the receiver of a fire command, wherein the memory unit includes a printed circuit board with a stored key which is hardwired during manufacture of the receiver and wherein the control logic allows initiation of the detonator after receipt of the fire command if a received reference key, extracted from the arm command, is the same as the stored key.

The arm command may be sent by a control device to the receiver.

If the received reference key equals the stored key then the control logic, using energy drawn from the power source, enables a fire voltage to be generated. As is known in the art the fire voltage may be used to charge a capacitor which, upon execution of the fire command, under the control of the control logic, is discharged to initiate the detonator.

BRIEF DESCRIPTION OF THE DRAWINGS

The invention is further described by way of example with reference to the accompanying drawings wherein.

DESCRIPTION OF PREFERRED EMBODIMENT

Figure 1:
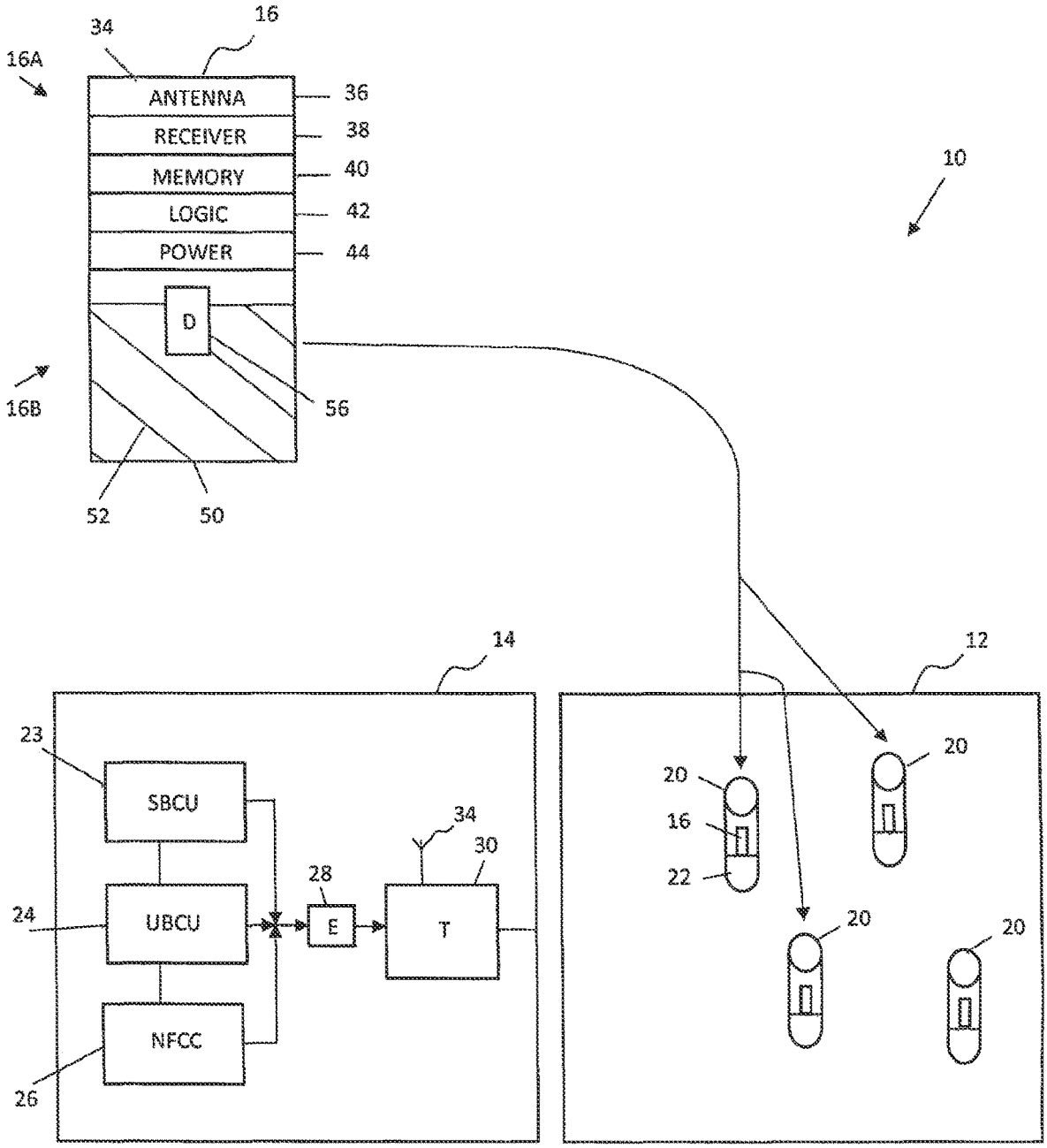
FIG. 1 schematically illustrates aspects of a blasting system based on the use of a wireless detonator assembly according to the invention.

FIG. 1 of the accompanying drawings illustrates a blast system 10 with a blast site 12, a control device 14, and a wireless detonator assembly 16 according to the invention. The detonator assembly 16 is one of a plurality of similar devices which are deployed at the blast site 12.

The blast site 12 includes a plurality of boreholes 20 which are formed in a known manner. Each borehole 20 is loaded with explosive 22 and at least one wireless detonator assembly 16.

The control device 14 includes at least one of the following, viz: a surface blast control unit 23, an underground blast control unit 24 and a near field communication card 26. The control device 14 further includes an encoder 28 and a transmitter 30.

The wireless detonator assembly 16 is typically used in an underground location and, in that event, the blast site 12 is a blast zone in an underground excavation. Primary benefits of using a wireless detonating arrangement are that there are no trailing wires or conductors leading to the detonators in the various boreholes, and generally the number of personnel required at the blast site is reduced. Thus there is enhanced reliability and safety in operation.

The transmitter 30 can operate at a radio frequency or it can transmit magnetic signals through the ground. The transmitter 30 has an antenna 34 which is configured accordingly. These types of transmission techniques are known in the art and for this reason are not further described.

The wireless detonator assemblies 16 are substantially identical to one another. Each assembly 16 includes a first part 16A and a second part 16B. These parts are interconnected to one another at an assembly location, not shown, at the blast site 12—a process which takes place immediately before placement of the detonator assemblies into the respective boreholes.

The first part 16A includes a housing 34 which contains or to which is mounted an antenna 36, a receiver 38, a memory unit 40, a logic module 42 and a power supply 44.

The second part 16B includes a housing 50 into which is loaded an explosive material 52.

When the first part 16A is connected to the second part 16B a detonator 56 is connected to terminals on the logic module 42 and is exposed to the explosive material 52. An advantage of this technique is that the part 16A is separate from the explosive 52, and the detonator 56 is separated from the explosive 52. Thus the likelihood of inadvertent initiation taking place is negligible.

The receiver 38 includes a printed circuit board 64 (see FIG. 2) which, during manufacture (66), is hardwired with a key 70. The key 70 may have any appropriate length and may be of any suitable format. In one example the key includes 32 bits. As the key is set during the manufacturing stage it cannot be altered after manufacture.

The key 70 which is hardwired into the printed circuit boards 64 of the various receivers 38 is stored as a reference key in the control device 14 i.e. in the surface blast control unit 23 or in the underground blast control unit 24 or otherwise is carried on a proprietary near field communication card 26. Any of these approaches can be used: the choice thereof depends on the system adopted at the blasting site.

When the detonator assemblies 16 at the blast site 12 are to be armed the reference key 70 which is available from one of the units 23 or 24 or from the NFC card 26 is encoded by the encoder 28 and is then transmitted in a signal 74 via the transmitter 30 simultaneously to the wireless detonator assemblies 16 in the various boreholes 20.

Figure 2:
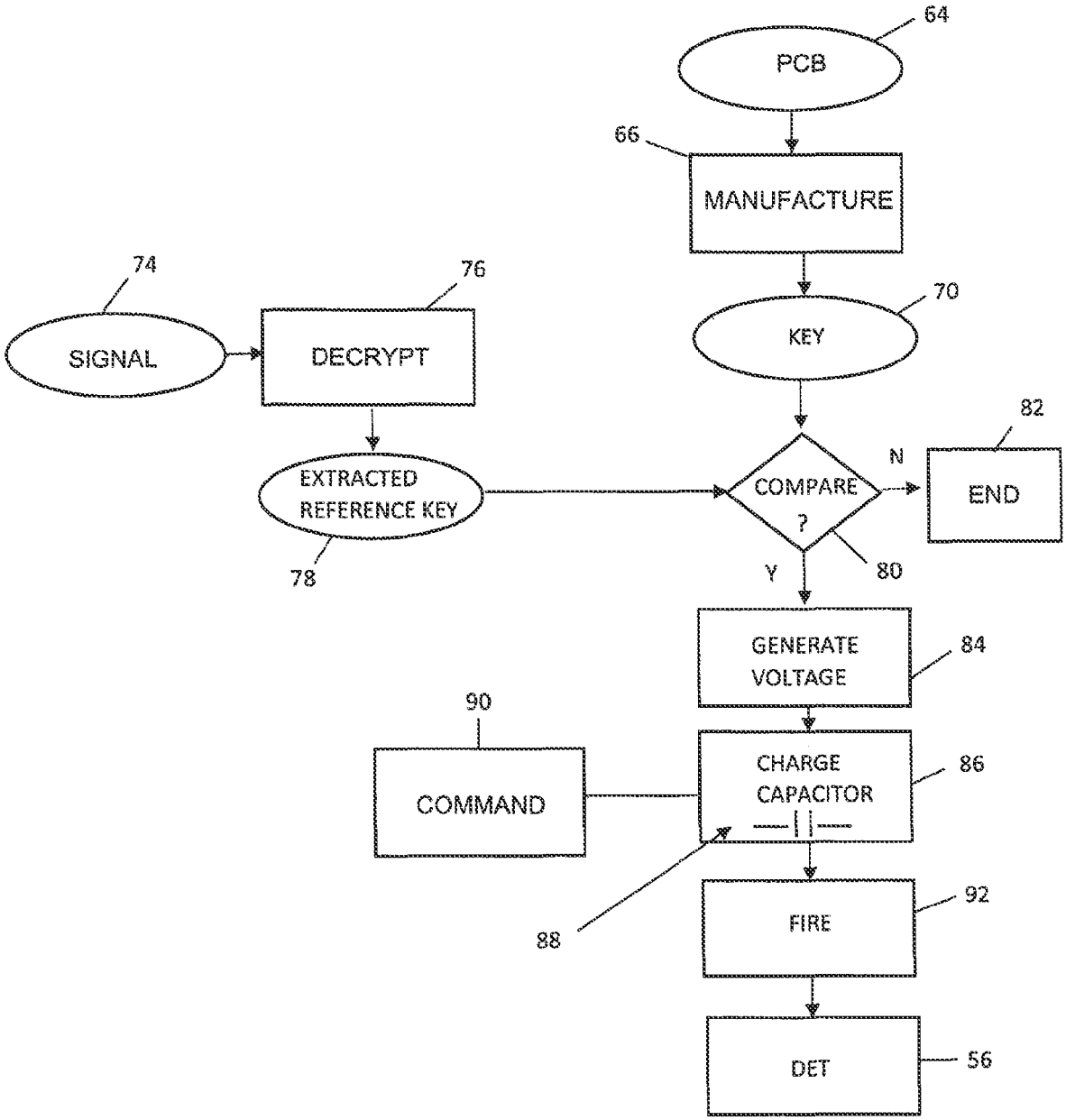
FIG. 2 illustrates a sequence of operations which is carried out when a wireless detonator assembly according to the invention is initiated.

As is shown in FIG. 2 the signal 74 transmitted by the transmitter 30 is received by the antenna 36 and receiver 38 of each detonator assembly 16. The respective logic module 42 decrypts the signal 74 and produces a decrypted signal 76. The logic module then extracts from the signal 76 the reference key which was encoded by the encoder 28. The extracted reference key, designated 78, is then compared (in a step 80) by the logic module 42 to the stored key 70 taken from the printed circuit board 64. If the keys are not identical it is not possible for the wireless detonator assembly 16 to be armed (step 82). If the keys are identical then the logic module 42, drawing energy from the power supply 44, causes a voltage to be generated (step 84), which voltage is sufficiently high to charge (step 86) a capacitor 88 as is known in the art. The capacitor 88, upon receipt by the receiver 38 of a fire command 90 sent by the control device 14, is caused to discharge and a fire signal 92 is sent to the detonator 56.

The use of the hardwired key 70 on the printed circuit board 64 of each detonator assembly 16 means that firing of a detonator 56 can only take place if the identical key (the reference key) is available from the control device 14 i.e. from one of the mechanisms 23, 24 or 26, according to requirement.

The invention claimed is:

1. A wireless detonator assembly which includes a receiver, a memory unit, a power source, control logic, a detonator and explosive material which is initiated, after receipt of an arm command, upon receipt by the receiver of a fire command, wherein the memory unit includes a stored key and wherein the control logic allows initiation of the detonator after receipt of the fire command if a received reference key, extracted from the arm command, is the same as the stored key, characterized in that the memory unit includes a printed circuit board and in that the printed circuit board is hardwired with the stored key during manufacture of the receiver.

2. A wireless detonator assembly according to claim 1 characterized in that the receiver is responsive to a signal sent from a control device which includes one of the following in which the reference key is stored: a surface blast control unit; an underground blast control unit; and a near field communication card.

3. A wireless detonator assembly according to claim 2 characterized in that the control logic is operable to extract the reference key from an encrypted signal which is transmitted by the control device.

* * * * *